US007659468B1

(12) United States Patent
Gottlieb

(10) Patent No.: US 7,659,468 B1
(45) Date of Patent: Feb. 9, 2010

(54) GUITAR STAND SYSTEM AND METHOD OF USE

(76) Inventor: Donald Gottlieb, 9 NW. 25th Ct., Delray Beach, FL (US) 33444

( * ) Notice: Subject to any disclaimer, the term of this patent is extended or adjusted under 35 U.S.C. 154(b) by 2 days.

(21) Appl. No.: 11/847,438

(22) Filed: Aug. 30, 2007

(51) Int. Cl.
*G10D 3/00* (2006.01)
*G10G 5/00* (2006.01)

(52) U.S. Cl. ..... 84/327; 248/443; 248/263; 248/225.11; 248/223.21; 248/223.41; 248/239

(58) Field of Classification Search ..... 248/263, 248/225.11, 223.41, 239, 223.21, 443; 84/327
See application file for complete search history.

(56) References Cited

U.S. PATENT DOCUMENTS

| | | | | | |
|---|---|---|---|---|---|
| 3,270,996 | A * | 9/1966 | Churchill et al. | ..... | 248/223.41 |
| 3,580,535 | A * | 5/1971 | Naske | ..... | 248/239 |
| 3,664,224 | A * | 5/1972 | Campagna, Jr. | ..... | 84/327 |
| 3,765,633 | A * | 10/1973 | Caudill | ..... | 248/229.12 |
| 4,084,778 | A * | 4/1978 | Dominguez | ..... | 248/314 |
| 4,345,732 | A * | 8/1982 | Gallegos | ..... | 248/201 |
| D270,120 | S * | 8/1983 | McPherson, Sr. | ..... | D6/567 |
| 4,865,225 | A * | 9/1989 | Chavez et al. | ..... | 222/108 |
| 4,924,597 | A * | 5/1990 | Tursi | ..... | 33/758 |
| 4,991,809 | A * | 2/1991 | Harkey | ..... | 248/229.12 |
| 5,054,170 | A * | 10/1991 | Otrusina | ..... | 24/580.11 |
| 5,098,237 | A * | 3/1992 | Harker | ..... | 411/21 |
| 5,313,866 | A * | 5/1994 | Smith | ..... | 84/327 |
| 5,346,168 | A * | 9/1994 | Astrella | ..... | 248/278.1 |
| 5,363,734 | A * | 11/1994 | Wilenken | ..... | 84/327 |
| 6,059,156 | A * | 5/2000 | Lehtinen | ..... | 224/197 |
| 6,199,352 | B1 * | 3/2001 | Beaston | ..... | 54/24 |
| 6,231,018 | B1 * | 5/2001 | Barbieri | ..... | 248/302 |
| 6,578,745 | B1 * | 6/2003 | Taylor et al. | ..... | 224/197 |
| 6,590,145 | B2 * | 7/2003 | Doiron | ..... | 84/327 |
| 6,802,694 | B2 * | 10/2004 | Bucher et al. | ..... | 416/210 R |
| 6,835,883 | B2 * | 12/2004 | Stevens | ..... | 84/453 |
| 6,848,605 | B2 * | 2/2005 | Dillenberger | ..... | 224/670 |
| 6,955,280 | B2 * | 10/2005 | Saitoh et al. | ..... | 224/269 |
| 7,151,213 | B2 * | 12/2006 | Hsieh | ..... | 84/453 |
| 7,166,789 | B2 * | 1/2007 | Warden | ..... | 84/327 |
| 7,255,313 | B2 * | 8/2007 | Lane | ..... | 248/222.41 |
| 7,351,896 | B2 * | 4/2008 | Clifford | ..... | 84/327 |
| 7,375,269 | B2 * | 5/2008 | Perkins | ..... | 84/327 |
| 7,446,249 | B2 * | 11/2008 | Driscoll | ..... | 84/327 |
| 2005/0000348 | A1 * | 1/2005 | Workman | ..... | 84/327 |
| 2008/0028913 | A1 * | 2/2008 | Driscoll | ..... | 84/327 |

* cited by examiner

*Primary Examiner*—Jeffrey Donels
*Assistant Examiner*—Robert W Horn
(74) *Attorney, Agent, or Firm*—Gold & Rizvi, P.A.; Glenn E. Gold; H. John Rizvi

(57) ABSTRACT

A guitar stand system including a bracket, a strap, and one or more studs. The bracket is provided with an upper portion having a horizontally projecting brace and a lower portion having a pair of downwardly projecting legs defining a slot therebetween. A pair of spaced apart hitches is provided on the upper portion of the bracket. The studs may be mounted on a stable object or structure and the bracket may be slidably engaged on the studs. A guitar may be leaned adjacent to the bracket. The strap, which is provided with an "O" ring at each end, may be drawn across the guitar neck and the "O" rings may be engaged on the hitches to confine the guitar securely on the stand.

5 Claims, 8 Drawing Sheets

GUITAR STAND SYSTEM AND METHOD OF USE

BACKGROUND OF THE INVENTION

1. Field of the Invention

The present invention relates generally to stands for musical instruments. More particularly, the invention relates to a guitar stand system that cooperates with an object or structure to provide a stand for safely and conveniently resting a guitar.

2. Description of the Prior Art

During rehearsals and performances, musicians find it necessary to periodically set their instruments aside, in order to play a different instrument, to take a rest break, or to complete some other activity. It is desirable to rest an instrument in a place that is protected from possible damage to the instrument, yet conveniently accessible when needed. Freestanding instrument stands are available in a variety of designs. Typically, the stands are tailored to receive a particular instrument and to hold the instrument in an upright orientation to conserve floor space. The stands are designed to hold the instrument without causing damage, which would affect the usefulness or cosmetic appearance of the instrument. Many stands are collapsible for convenient storage and transport.

It is common for musicians to rehearse, record, and perform in an area crowded with equipment. In addition to lighting, microphone stands and wiring, larger equipment such as amplifiers and combination amplifiers are frequently present in the area where musicians are working. Many musicians perform on multiple instruments, and instruments not currently being used typically rest on a stand. The stand is preferably located in a place that is safely out of the way but conveniently accessible. With space being at a premium, it is inconvenient to place a freestanding instrument stand among the other items of equipment on stage or in a studio.

While freestanding instrument stands are designed to be as compact as possible, some floor space is occupied by the supports for the stand. It is desirable to have a relatively large base for the supporting members of an instrument stand to prevent the stand from toppling over, in the event of accidental contact with moving persons or equipment. Modern music performances involve significant amounts of activity on stage and instrument stands are susceptible to toppling. Certain instruments, such as guitars, present particular difficulties. The relatively long neck and rounded body make guitars susceptible to being toppled over and unsuitable for simply leaning against an object, such as an amplifier. There is a need for a guitar stand system that occupies minimal floor space and holds the guitar without damage to the instrument. There is a need for a guitar stand that holds the instrument securely against toppling and which allows the guitar to be easily and conveniently released, when the instrument is needed.

SUMMARY OF THE INVENTION

The present invention is directed to a compact and easily transported guitar stand system, which is designed for conveniently and securely holding a guitar adjacent to an object, or a structure, such as a full-stacked amplifier, a half-stacked amplifier, and a combination amplifier. The guitar stand system is designed to attach to a stable object or structure to prevent accidental toppling of the instrument.

The guitar stand comprises a vertically extending elongate bracket, a strap, and one or more studs. The bracket has an upper portion and a lower portion. The upper portion is provided with a horizontally projecting brace and the lower portion is provided with a pair of downwardly projecting legs, in spaced apart relation and defining a slot between them. A pair of hitches is mounted on the upper portion in spaced apart relation. The strap is designed for partially surrounding the neck of a guitar and includes a pair of fastener means for engaging the hitches. The studs are designed to cooperate with the slot to engage and retain the bracket. The studs may be mounted on the side of an object or structure, such as an amplifier or combination amplifier, in vertical alignment.

The bracket may be slidably engaged on the studs to confine the bracket on the side of the object or structure. A guitar may be placed in contact with the upper portion of the bracket, which may be padded to protect the guitar. The strap may be drawn across the guitar neck, in partially surrounding relation, and the fastener means may engage the hitches and hold the guitar adjacent to the object or structure. The guitar can be easily retrieved by simply releasing the fastener means and then removing the guitar. While the fastener means are engaged, the guitar is securely retained, taking advantage of the stability of the object or structure to prevent toppling.

It is an object of the present invention to provide a guitar stand system that occupies minimal floor space and holds a guitar without damage to the instrument.

It is an object of the present invention to provide a compact, lightweight, and easily transportable guitar stand.

It is another object of the present invention to provide a guitar stand system that holds a guitar securely against toppling.

It is yet another object of the present invention to provide a guitar stand system that allows the guitar to be easily and conveniently released when needed.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

As shown in the attached drawings, the present invention is directed toward a guitar stand system designed for mounting on an object or structure. The guitar stand is compact and is capable of holding a guitar adjacent to the object or structure without damage to the guitar and without exposing the guitar to the risk of toppling. The guitar may be easily released from the guitar stand when needed.

Figure 1:
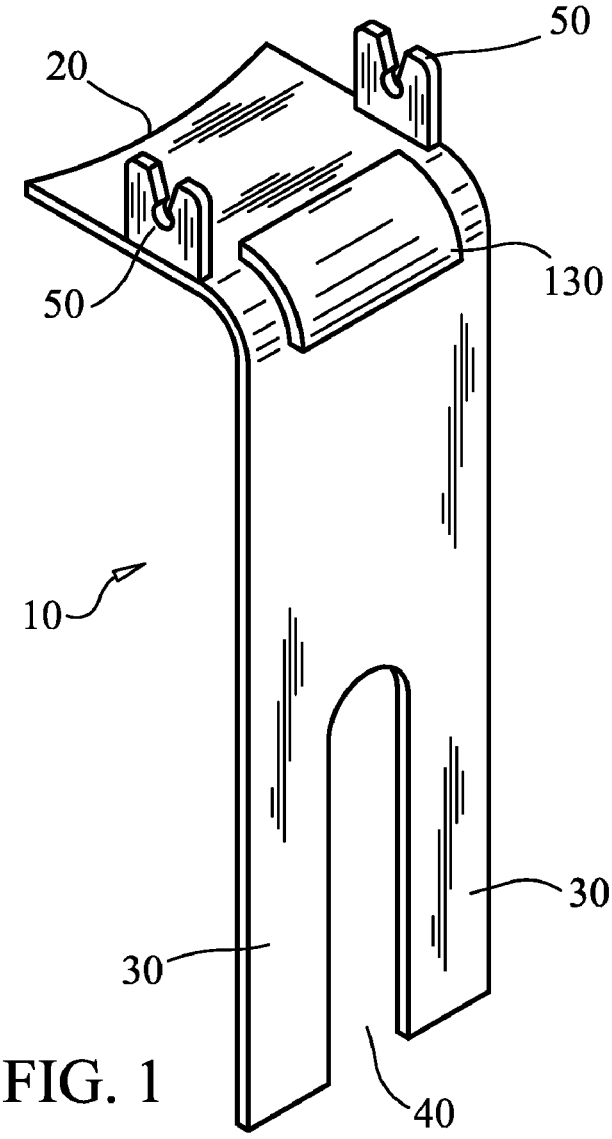
FIG. 1 is a perspective view of the bracket portion of the present invention.
Figure 3:
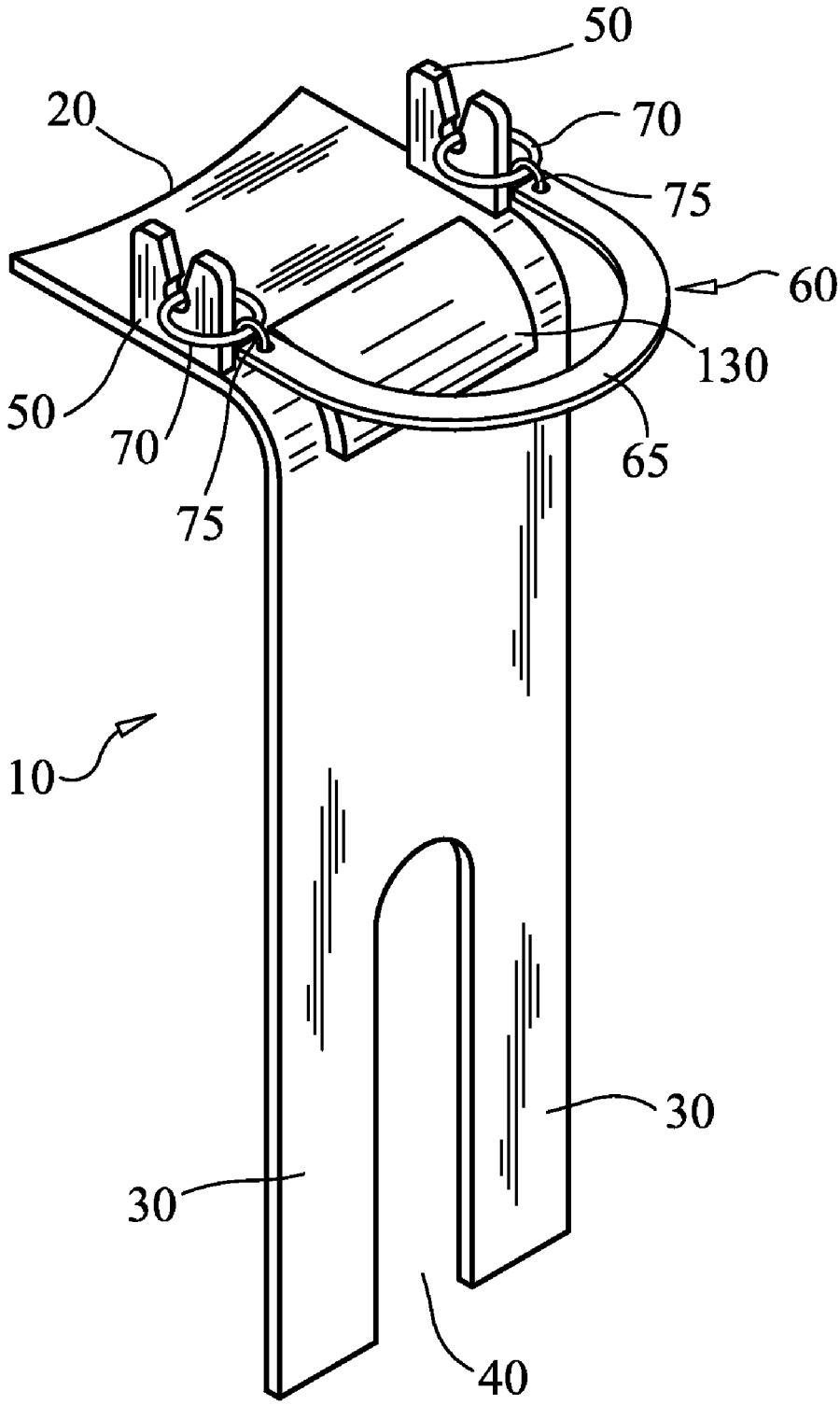
FIG. 3 is a perspective view of the bracket and strap of the present invention with the fastener means engaged.

The guitar stand system includes an elongate vertically extending bracket, a strap, and one or more studs. The bracket 10, as shown in FIGS. 1 and 3, is preferably formed of a generally planar section of plastic or metal having a generally rectangular shape, a thickness of approximately 0.4 cm. (0.15 in.) and a width slightly greater than the width of the neck of a guitar intended to be secured thereto. Lexan® plastic and steel are suitable materials. Other plastics and metals may also serve to form the bracket 10. The bracket 10 has an upper portion and a lower portion. The upper portion is provided with a horizontally projecting brace 20. The lower portion is provided with a pair of downwardly extending, spaced apart, legs 30, which define a slot 40 between them. The horizontally projecting brace 20 is preferably formed by bending the steel upper portion to an angle of approximately 90 degrees, as shown in FIG. 1. The legs 30 may preferably be formed by cutting or stamping the slot 40 in the lower portion of the bracket 10. The bracket 10, including the brace 20 and legs 30 may be formed by molding plastic such as Lexan® in a single unit. The brace 20 and the legs 30 may also be formed separately and joined to form the bracket 10.

A pair of hitches 50 is provided on the upper portion of the bracket 10. The hitches 50 are preferably formed of the same material as the bracket 10 and may be formed separately and joined to the bracket 10 or may be molded as a single unit. Each of the hitches 50 includes an upstanding panel having a cut out in the shape of an inverted letter "T" opening at an upper edge of the panel, as shown in FIGS. 1 and 3. It is preferred that the hitches 50 be mounted on the brace 20, in spaced apart relation generally matching the width of the brace 20.

Figure 2:
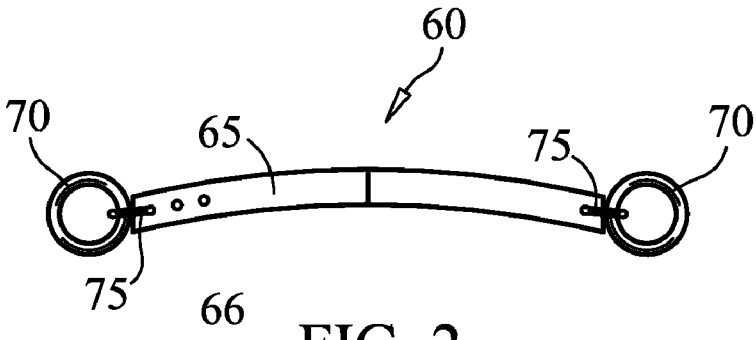
FIG. 2 is a perspective view of the strap portion of the present invention.

The strap 60 is shown in FIGS. 2 and 3. The strap 60 is preferably formed of an elongate band 65, preferably elastic, having a first end and a second end with each of the ends having a fastener means provided thereon. Each of the fastener means is configured to engage a one of the cut outs in the hitches 50 and may preferably be a rubber "O" ring 70 of conventional design attached to the band 65 by conventional means such as by passing a metal ring 75 through the "O" ring 70 and through a hole provided in the band 65. The band 65 is preferably formed of rubber. Other conventional means of securing the "O" ring 70 may be substituted and other conventional fastener means may be substituted for the "O" ring 70.

An alternative strap (not shown) may be formed of a loop of elastic material such as rubber and a flexible sleeve, also of rubber encircling a portion of the elastic loop such that an eye formed of a protruding portion of the loop is presented at each end of the sleeve. Each eye may serve as a fastener means and the sleeve may serve as an intermediate portion of the strap.

Figure 6:
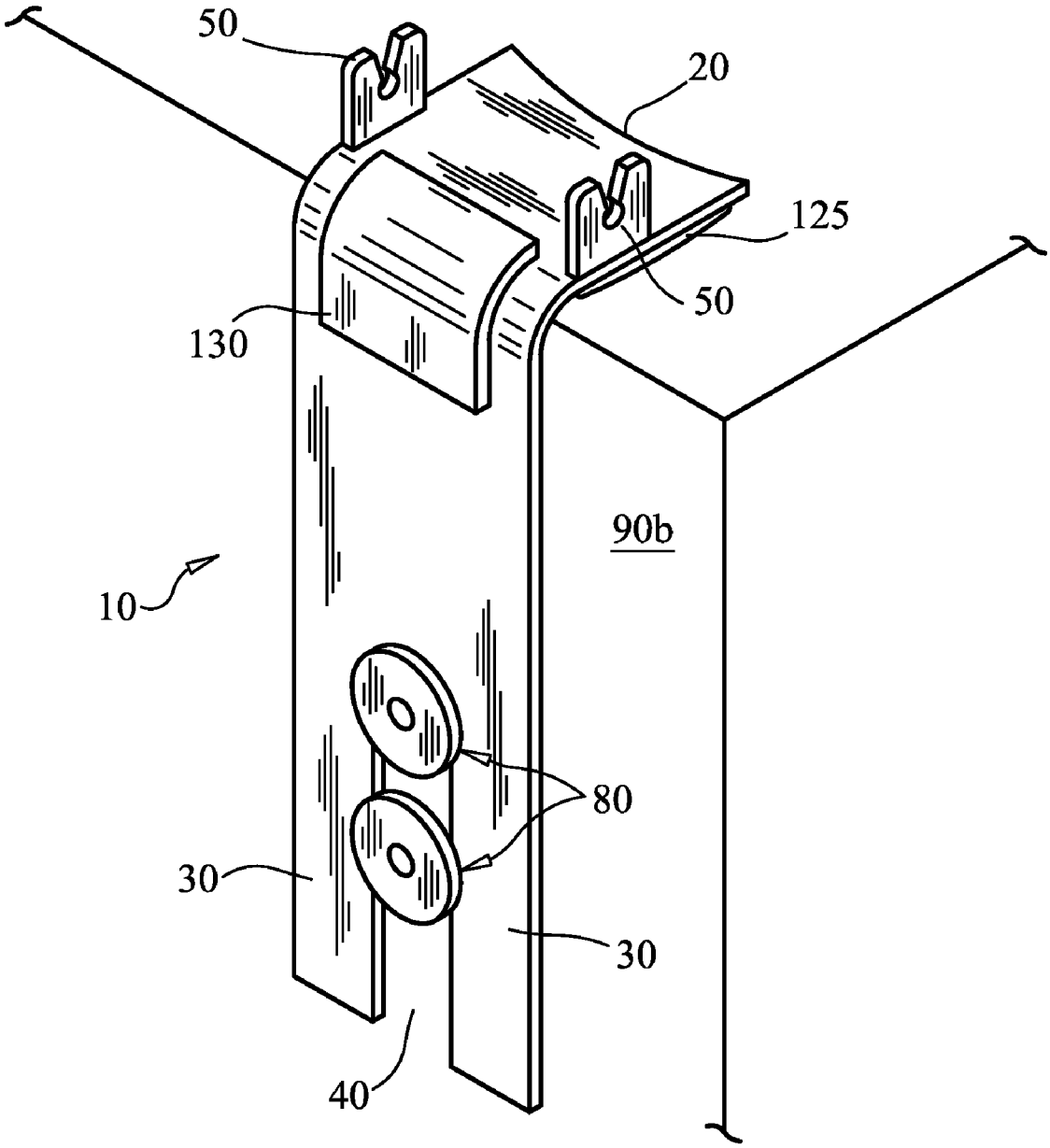
FIG. 6 is a side perspective view of the guitar stand system of the present invention mounted about a top surface edge of an amplifier.
Figure 7:
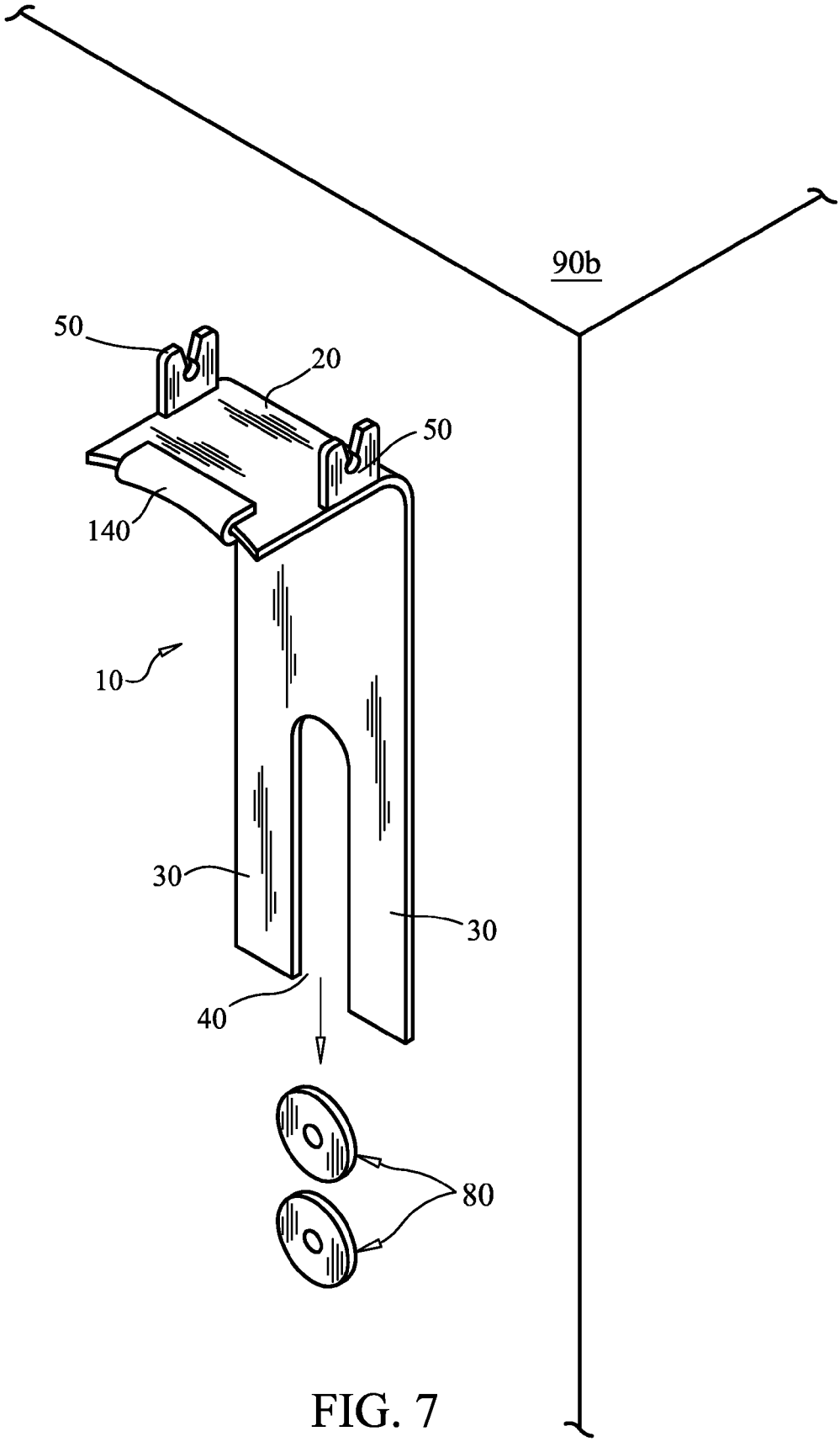
FIG. 7 is a side perspective view of the guitar stand system of the present invention mounted on the side of an amplifier (e.g., a lower unit of a full stack amplifier).
Figure 9:
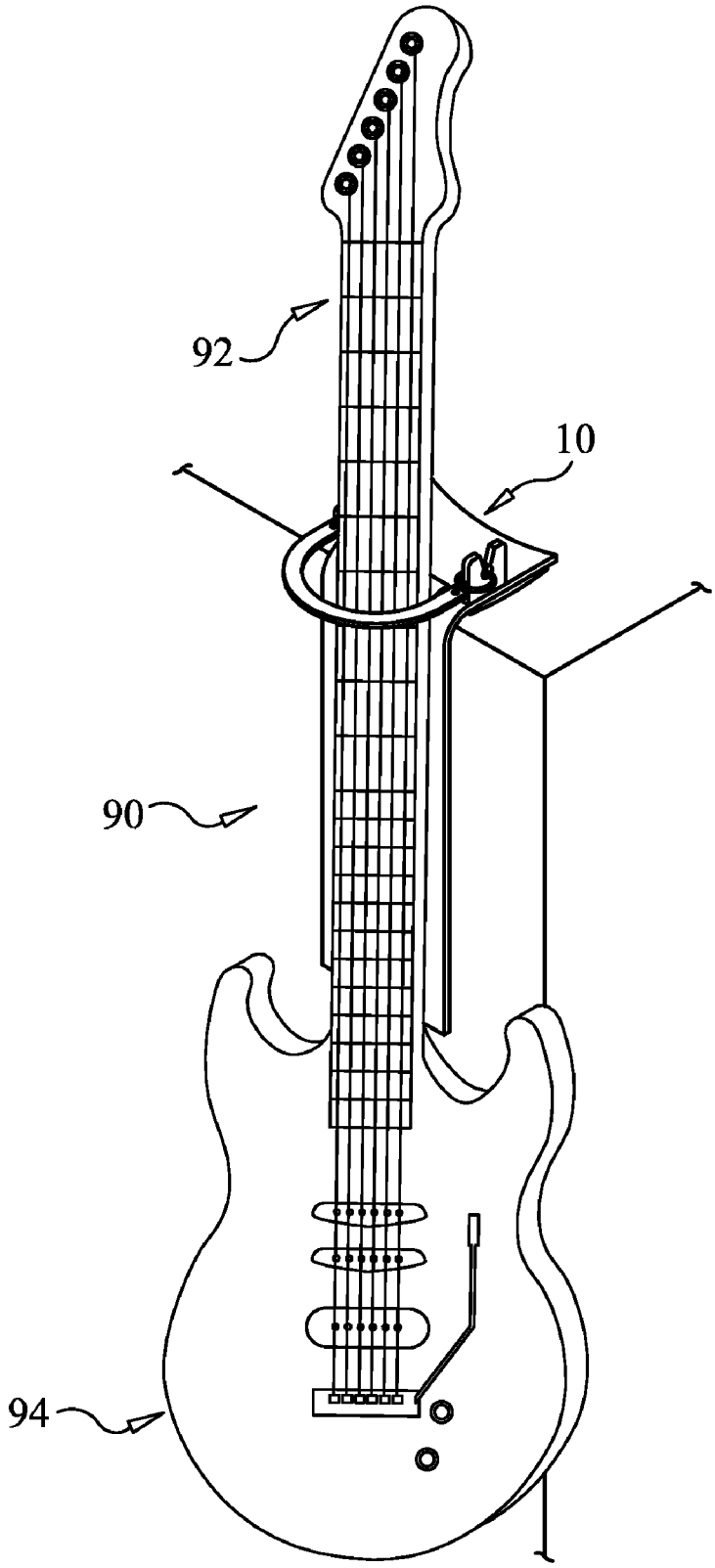
FIG. 9 is a side perspective view of the guitar stand system of the present invention mounted about the top surface edge of an amplifier, with a guitar secured thereto.
Figure 10:
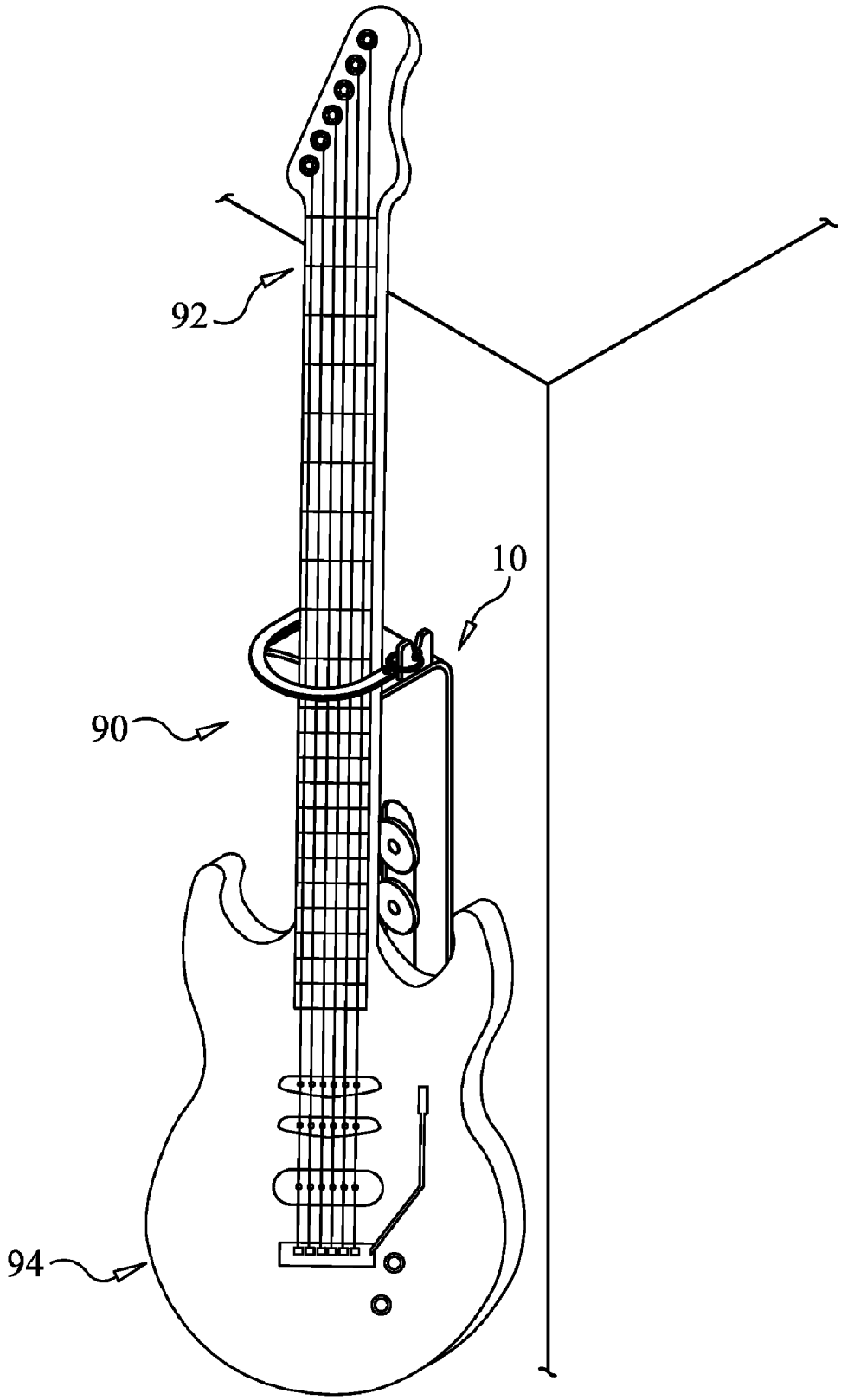
FIG. 10 is a side perspective view of the guitar stand system of the present invention mounted on the side of an amplifier (e.g., a lower unit of a full stack amplifier) with a guitar secured thereto.

One or more studs 80 are mounted on an object or structure. The studs 80 are depicted on the side of an amplifier 90*a*, in FIG. 4. The studs 80 are intended to be mounted in vertical alignment and are configured to be received within the slot 40 of the bracket 10, so as to confine the bracket 10 adjacent to the amplifier 90*a*. The bracket 10 may be slideably lowered onto the studs 80, with the bracket 10 oriented so as to rest the brace 20 on a top surface of the amplifier 90*a*, as shown in FIG. 6, to produce a first configuration, as explained below. Alternatively, the bracket 10 may be reversed so that the brace 20 faces outward from the side of a stacked-type amplifier 90*b*, as shown in FIG. 7, to produce a second configuration as also explained below. It is preferred that at least two studs 80 be received within the slot 40 in order to provide sufficient stability.

Figure 4:
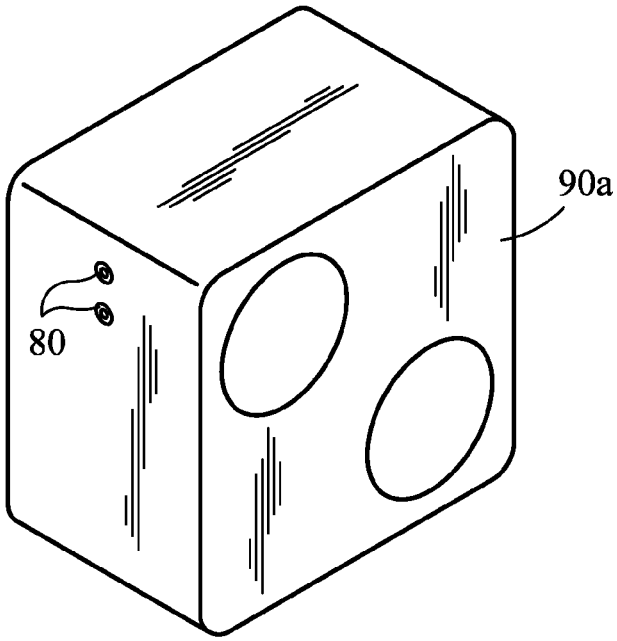
FIG. 4 is a side perspective view of a combination style music amplifier with studs mounted proximate to the top surface.
Figure 5:
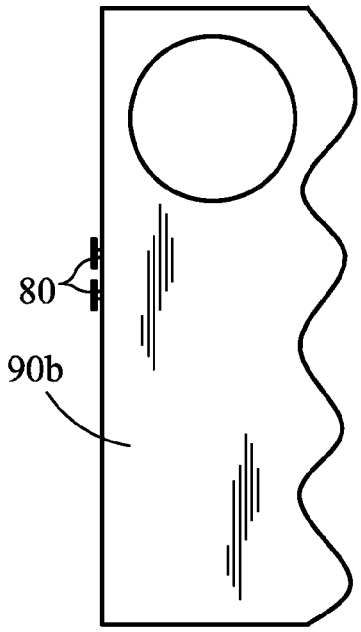
FIG. 5 is a side perspective view of the music combination amplifier with studs mounted on a side.
Figure 8:
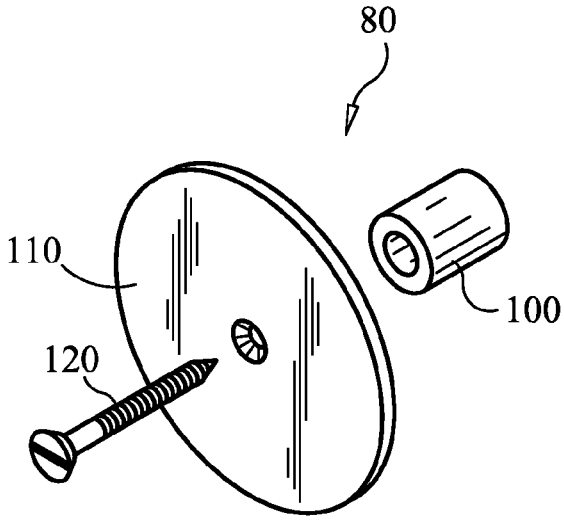
FIG. 8 is an exploded view of a stud of the present invention.

The studs 80 are preferably formed of a spacer 100 and a washer 110 as shown in FIG. 8. Preferably a wood screw 120 is counter sunk into the washer 110, passed through a bore provided in the spacer 100 and driven into the surface of the amplifier 90*a* or stacked-type amplifier 90*b*, as shown in FIGS. 4 and 5, respectively. It is preferred that the spacer 100 have a length selected to displace the washer 110 from the amplifier 90*a* or stacked-type amplifier 90*b* by a distance slightly greater than the thickness of the bracket 10 and that the washer 110 have a diameter greater than the width of the slot 40. It is preferred that the slot 40 have a width of approximately 1.3 cm. (0.5 inches), that the washer 110 have a diameter of approximately 1.9 cm. (0.75 inches), and that the spacer 100 have a diameter slightly less than the width of the slot 40.

In use the guitar stand system of the present invention is capable of providing a safe, secure, and convenient guitar stand. It is intended that the studs 80 be mounted on a stable object or structure at a location easily accessible to the musician. Frequently, it is most convenient to mount the studs 80 on the side of an amplifier 90*a* or stacked-type amplifier 90*b*, as shown in FIGS. 4 and 5, however; the present invention is suitable for mounting on any stable object or structure, which may be available and convenient. A wall and a stairway carriage are examples of structures on which the studs 80 may be mounted. The bracket 10 is designed for attachment in two possible configurations. In a first configuration, the studs 80 are mounted on the side of an object or structure, proximate to a top surface and the bracket 10 is slidably engaged on the studs 80 in an orientation such that the brace 20 rests on the top surface, as shown in FIG. 6. It is advantageous to secure the brace 20 to the top of the object or structure, for additional stability. Securing means, such as hook and loop fasteners 125, are a suitable method, as shown in FIG. 6, and the brace 20 may be secured by affixing the hook material to the top of the object or structure and the loop material to the underside of the brace 20. It is also advantageous to provide a guitar neck pad 130 on the upper portion of the bracket 10 opposite the brace 20 to cushion the guitar neck and strings. The guitar body may be rested on a support surface proximate to the object or structure and the guitar neck may be leaned adjacent to the guitar neck pad 130. The strap 60 may be drawn across the guitar neck, in partially surrounding relation, and each "O" ring 70 may be engaged in a one of the cut outs in each of the hitches 50 to confine the guitar neck adjacent to the bracket 10. An alternate embodiment of the present invention may be provided wherein one hitch is configured with one fastener means permanently engaged on the hitch and the other of the pair of hitches is configured for releasable engagement of the fastener means.

In a second configuration, the studs 80 are mounted on the side of an object or structure not necessarily proximate to a top surface, as shown in FIG. 5. The second configuration is desirable if the object or structure, such as the stacked-type amplifier 90*b*, is sufficiently tall to prohibit convenient attachment of the bracket 10 proximate to the top surface. The bracket 10 is slidably engaged on the studs by orienting the bracket 10 such that the brace 20 faces outward and by lowering the bracket 10 onto the studs 80. It is desirable that the distal edge of the brace 20 have a concave shape and an edge pad 140 be affixed to the distal edge, for cushioning the guitar neck and strings. The guitar may be leaned adjacent to the brace 20 and the strap 60 may be engaged as set forth in the first configuration to retain the guitar adjacent to the brace 20. Likewise, the guitar may be released from the stand as explained above.

Having fully described the present invention, it will be appreciated that minor variations of the embodiments disclosed herein may be made without departing from the scope of the invention as disclosed and claimed herein.

Figure 11:
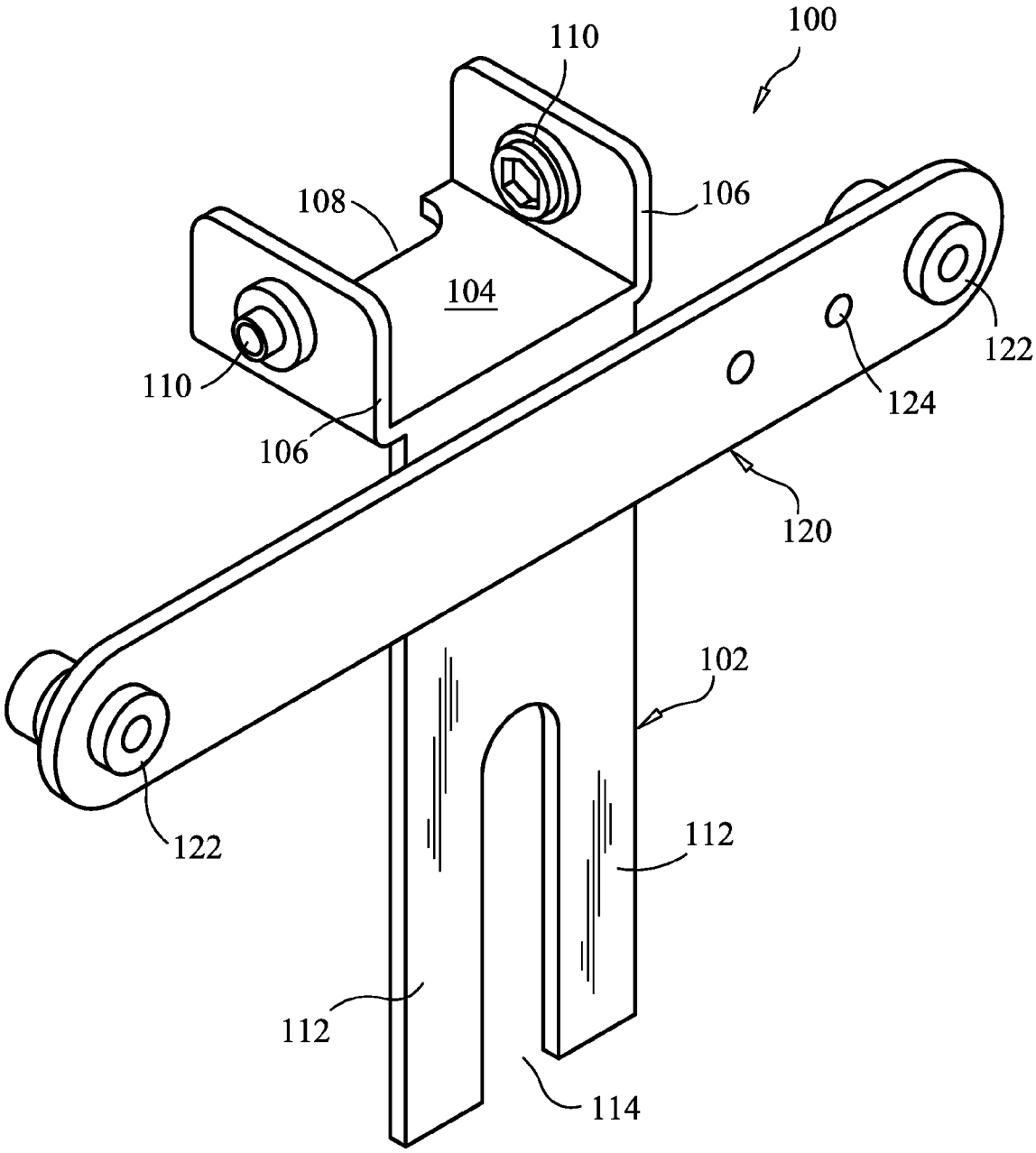
FIG. 11 is a side perspective view of a bracket and strap arrangement in accordance with an alternate embodiment of the present invention.

For example, referring particularly to FIG. 11, in conjunction with FIG. 1, an alternate embodiment of the bracket and strap arrangement is shown. The main substantially conforms to the brace shown in FIG. 1. Particularly, the bracket 100 has an upper portion and a lower portion, the lower provided with a horizontally projection brace 108, and the lower portion provided with a pair of downwardly extending, spaced apart, legs 112, defining a slot 114 between them. However, the bracket incorporates a pair of spaced vertically disposed bracket walls 106—each having an integral mechanical snap mechanism 110—in lieu of the hitch configuration 50 (FIG. 1). Additionally, in lieu of strap 60 (FIG. 1), resilient band 120 is provided. The band 120 has a pair of mechanical fasteners 122, such as snaps, that can be releasably secured to the corresponding snap mechanisms 110 in bracket sidewalls 106. A plurality of spaced-apart apertures 124 is provided extending through band 120. In this manner, the mechanical fasteners 122 can be removed from one aperture and reattached to another aperture, to facilitate adjustment of the band for securing guitars having different sized necks.

What is claimed is:

1. A guitar stand system for releasably retaining a guitar adjacent to an object or structure comprising:

a vertically extending elongate bracket, a strap, and one or more studs;

said bracket having an upper portion and a lower portion;

said upper portion having a horizontally projecting brace and a pair of hitches disposed in spaced apart relation;

said lower portion having a pair of downwardly projecting legs in spaced apart relation and defining a slot therebetween;

said strap includes a pair of fastener means and is designed for partially surrounding a neck of said guitar;

each of said hitches being configured to receive and engage a one of said fastener means, and at least one of said hitches being configured to engage said fastener means in releasable engagement;

said studs being designed to slideably engage said slot and to retain said bracket;

whereby said studs may be mounted in vertical alignment on said object or structure, said bracket may be slideably engaged on said studs, said guitar may be positioned with the guitar neck adjacent to said bracket, said strap may be drawn across said guitar neck, in partially surrounding relation, and engaged with said hitches to confine said guitar adjacent to said object or structure.

2. The guitar stand of claim 1, wherein said brace includes a distal edge having a concave shape and an edge pad affixed to said distal edge for cushioning said guitar neck and strings.

3. The guitar stand of claim 1, wherein said upper portion of said bracket includes a guitar neck pad affixed to said upper portion for cushioning said guitar neck and strings.

4. The guitar stand of claim 1, wherein said strap comprises an elongate band having a first end and a second end;

said pair of fastener means comprise a pair of "O" rings, one of said pair being affixed to said first end and the other of said pair being affixed to said second end.

5. The guitar stand of claim 1, further including securing means for attaching an underside of said brace to a top surface of said object or structure.

* * * * *